US008081787B2

(12) United States Patent
Haenggi et al.

(10) Patent No.: US 8,081,787 B2
(45) Date of Patent: Dec. 20, 2011

(54) HEARING ASSISTANCE SYSTEM AND METHOD OF OPERATING THE SAME

(75) Inventors: Stefan Haenggi, Bern (CH); Herbert Baechler, Meilen (CH)

(73) Assignee: Phonak AG, Staefa (CH)

( * ) Notice: Subject to any disclaimer, the term of this patent is extended or adjusted under 35 U.S.C. 154(b) by 180 days.

(21) Appl. No.: 12/520,733

(22) PCT Filed: Dec. 20, 2006

(86) PCT No.: PCT/EP2006/012348

§ 371 (c)(1),
(2), (4) Date: Jan. 18, 2010

(87) PCT Pub. No.: WO2007/039320

PCT Pub. Date: Apr. 12, 2007

(65) Prior Publication Data

US 2010/0128906 A1 May 27, 2010

(51) Int. Cl.
*H04R 25/00* (2006.01)

(52) U.S. Cl. ..... 381/315; 381/312

(58) Field of Classification Search ..... 381/312–315, 381/23.1, 105; 455/41.1, 41.2; 340/12.22, 340/12.5

See application file for complete search history.

(56) References Cited

U.S. PATENT DOCUMENTS

| | | | | |
|---|---|---|---|---|
| 4,947,432 | A | 8/1990 | Topholm | |
| 5,434,924 | A * | 7/1995 | Jampolsky | 381/23.1 |
| 5,991,419 | A * | 11/1999 | Brander | 381/312 |
| 6,137,888 | A | 10/2000 | McClennon et al. | |
| 6,549,633 | B1 | 4/2003 | Westermann | |
| 6,587,568 | B1 | 7/2003 | Sigwanz | |
| 6,816,600 | B1 | 11/2004 | Jakob et al. | |
| 7,580,535 | B2 * | 8/2009 | Baechler | 381/315 |
| 2003/0076974 | A1 | 4/2003 | Barthel et al. | |
| 2004/0037442 | A1 | 2/2004 | Nielsen et al. | |
| 2004/0053575 | A1 | 3/2004 | Eckert et al. | |
| 2005/0117764 | A1 | 6/2005 | Arndt et al. | |
| 2005/0157896 | A1 * | 7/2005 | Maltan et al. | 381/315 |
| 2006/0018496 | A1 | 1/2006 | Niederdrank et al. | |
| 2006/0109994 | A1 | 5/2006 | Husung et al. | |

FOREIGN PATENT DOCUMENTS

| | | | |
|---|---|---|---|
| DE | 100 48 338 | A1 | 4/2002 |
| EP | 1 093 102 | A1 | 4/2001 |
| EP | 1 326 480 | A2 | 7/2003 |
| EP | 1 420 611 | A1 | 5/2004 |
| EP | 1 501 200 | A2 | 1/2005 |
| WO | 99/66741 | A2 | 12/1999 |

* cited by examiner

*Primary Examiner* — Tuan Nguyen
(74) *Attorney, Agent, or Firm* — Roberts Mlotkowski Safran & Cole, P.C.

(57) ABSTRACT

A system providing hearing assistance to a user having a wireless remote control for transmitting control commands as an amplitude modulated radio frequency signal, an RF power detector for outputting a signal representative of the power envelope of the RF signal received by an antenna of the RF power detector, a classifier unit for analyzing the output signal of the RF power detector to detect control commands of the remote control and to detect the presence of a source of interfering RF signals, an audio signal processing unit, and a user's ear worn part for stimulating the user's hearing according to audio signals processed in the audio signal processing unit. The classifier unit provides a control signal representing detected remote control commands and an interference signal representing the presence of a source of interfering RF signals. Operation of the audio signal processing unit is controlled by the control signal.

37 Claims, 3 Drawing Sheets

HEARING ASSISTANCE SYSTEM AND METHOD OF OPERATING THE SAME

BACKGROUND OF THE INVENTION

1. Field of the Invention

The invention relates to a hearing assistance system comprising a wireless remote control for transmitting control commands as an amplitude modulated radio frequency signal, a radio frequency (RF) power detector for outputting a signal representative of the power envelope of the RF signal received by an antenna of the RF power detector, an audio signal processing unit, and means worn to be worn at or at least in part in the user's ear for stimulating the user's hearing according to audio signals processed in the audio signal processing unit. The invention also relates to a method of operating such a hearing assistance system.

2. Description of Related Art

Hearing instruments comprising means for stimulating the user's hearing according to audio signals processed in the audio signal processing unit of the hearing instrument often are used together with a dedicated, usually wireless, remote control in order to allow the user to interact with the hearing instrument via an interface which is more convenient and has more features than the one provided by the hearing instrument. Examples of such systems are described in European Patent Applications EP 1 420 611 A1 and EP 1 326 480 A2, German Patent Application DE 100 48 338 A1, U.S. Pat. Nos. 6,816,600 and 4,947,432.

Such hearing assistance systems in addition often comprise a remote device spaced apart from the hearing instrument for establishing a wireless link between the remote device and the hearing instrument for transmitting audio signals from the remote device to the hearing device.

Examples of such hearing assistance systems are binaural hearing aids (in this case the remote device is a hearing instrument which is worn at the other one of the user's ears, with both hearing instruments being hearing aids comprising a microphone and an output transducer); in this case the link may serve as a bi-directional data link for exchanging audio signals, control data, and/or commands between the hearing aids.

Other examples of such a hearing assistance systems are CROS or BiCROS systems (in this case the remote device is a wireless microphone worn at the other one of the user's ears). In a CROS (also spelled CROSS) system the hearing instrument does not comprise a microphone, while in a BiCROS (also spelled BiCROSS) system the hearing instrument comprises a microphone, depending on whether the ear at which the hearing instrument is worn needs hearing assistance or not. In both cases the ear at which the wireless microphone is worn is essentially unable to be aided by a hearing instrument.

According to further examples of such hearing assistance systems the remote device is a remote control for the hearing instrument (in this case the link is for transmitting control data and/or commands from the remote control to the hearing instrument), an external microphone worn by another person (for example a teacher) or an external microphone worn by the user at a place other than the ears, or a device for wireless transmission of audio signal from a external audio signal source, such as a telephone, a television, an external microphone, a hi-fi-system, etc.

Generally, the receiver unit for the wireless link could be integrated within the hearing instrument/hearing aid, or the receiver unit could be a separate device which is mechanically and electrically connected to the hearing instrument/hearing aid, usually via an "audio shoe" in order to provide the audio signals received over the wireless link to an audio input of the hearing aid.

In such known systems the wireless link from the remote device to the receiver unit included in or connected to the hearing instrument may be heavily disturbed if a source of interfering radio frequency signals comes close to the hearing instrument. A typical example for such interfering radio frequency source is a mobile phone. Typically, a mobile phone transmits TDMA (time division multiple access) signals, for example according to the GSM (global system for mobile communications) standard. In this case transmission from the mobile phone occurs periodically, with only ⅛ of the time being used for transmission. A similar periodic transmission scheme is found in cordless telephone systems using the DECT standard; also in this case only a relatively small fraction of each period is used for transmission. This applies similarly also to devices using the Bluetooth standard.

If such interfering radio frequency source is brought very close to the hearing instrument worn had the user's ear, the link between the remote device and the hearing instrument may break down, what is very inconvenient for the user. Such radio frequency sources may be considered as "burst interferes".

However, also systems which do not include such remote device may suffer from interfering radio frequency signals which may affect the audio path of the hearing instrument, thereby producing unwanted audio artifacts.

Examples of wireless links for binaural hearing aid systems are found in U.S. Pat. No. 6,549,633 and U.S. Patent Application Publication 2004/0037442 A1.

According to U.S. Patent Application Publication 2005/0117764 A1 the use of a DECT or GSM phone at one of the two sides of a hearing aid set is detected by analyzing the level difference between the left ear and right ear hearing coil in order switch the respective hearing aid to a phone mode.

According to U.S. Pat. No. 6,587,568 and European Patent Application EP 1 501 200 A2 a hearing aid is capable of recognizing periodic RF (radio frequency) interference signals, for example from mobile phones, with the gain of the hearing aid being synchronized to the periodicity of the RF interference signals, so that the gain of the hearing aid is reduced or even set to zero during the presence of an interfering RF burst. According to U.S. Patent Application Publication 2003/076974 A1 a hearing aid is capable of detecting the presents of characteristic RF interference signals in order to not only switch the gain of the hearing aid accordingly but also to switch other parameters, such as the filter band width, of the hearing aid accordingly. Thereby specific auditory scenes can be recognized, in particular the use of a telephone, in order to adapt the operation mode of the hearing aid accordingly.

SUMMARY OF THE INVENTION

It is an object of the invention to provide for a hearing assistance system comprising a remote control, an audio signal processing unit and means for stimulating the user's hearing according to audio signals processed in the audio signal processing unit, which is structurally simple and which nevertheless is able to deal with interfering RF-signals. It is a further object of the invention to provide for a method for operating such hearing assistance system.

According to the invention these objects are achieved by a system and a method that is beneficial in that, by using a RF power detector for outputting a signal representative of the power envelope of the RF signal received by the RF power detector together with a classifier unit for analyzing the output signal of the RF power detector in order to detect both control commands of the remote control and the presence of a source of interfering RF signals, a particularly simple system is provided which not only allows the system to be controlled by the remote control but in addition also allows to detect interfering RF signals so that specific countermeasures may be taken. Thus, the RF power detector not only serves to detect interfering RF signals—as in the prior art mentioned above—but in addition also serves to establish a wireless link to a remote control.

The interference signal provided by the classifier unit may be used to control the audio signal processing unit in such a manner that noise caused by the presence of the interfering RF signals is suppressed.

Preferably the audio signal processing unit, the stimulating means and the classifier unit are part of a hearing instrument to be worn at or at least in part in the user's ear, such as a behind the ear (BTE) hearing aid, an in the ear (ITE) hearing aid or a completely in the channel (CIC) hearing aid.

The system may comprise a remote device spaced apart from the hearing instrument for establishing a wireless link between the remote device and the hearing instrument for transmitting audio signals from the remote device to the hearing instrument. In this case, the interference signal from the classifier unit may be used to synchronise the transmission of signals from the remote device to the hearing instrument to the detected power scheme of the interfering signals in such a manner that the signals are transmitted only during the low power regimes of the interfering signals. The remote device may be a microphone unit to be worn at the other one of the user's ears, and external microphone to be worn by, for example, another person, a device for wireless transmission of audio signals from an audio signal source to the hearing instrument, or a hearing instrument of a binaural system.

Preferably, the classifier unit is capable of recognising the type of interfering RF signals, with the interference signal provided by the classifier unit comprising information regarding the type of the source of interfering RF signals. For example, the source of interfering RF signals may be a mobile phone which usually emits time-division-multiple-access (TDMA) signals, which often obey the GSM standard. If the interfering RF signals are found to occur according to a predictable scheme, the classifier unit may be used to predict the times when the low power regimes and the high power regimes of the Interfering RF signals are to be expected, so that the audio processing unit may be controlled according to such predictions of the classifier unit.

Preferably, the classifier unit is capable of determining the distance of the source of interfering RF signals from the RF power detector in order to produce an interference source distance signal; in addition, the classifier unit may be capable of determining also the distance of the remote control from the RF power detector in order to output a remote control distance signal. These distance signals may be produced by a channel loss model of the classifier unit, which includes a transmission power library of the maximum transmission power of the remote control and of the standards of maximum transmission power of the expected types of sources of interfering RF signals, wherein the distance is determined by comparing the present transmission power determined by a RF power detector and the respective value in the transmission power library.

In the case of a binaural system the distance of the source of interfering RF signals may be determined by both hearing instruments, i.e. by the respective RF power detector of each of the hearing instruments, whereby the location of the source of interfering RF signals may be estimated by comparing the values of the distance, i.e. the interference source distance signals, provided by teach of the classifier units of the two hearing instruments. Thereby it can be determined, for example, to which of the hearing instruments the source of interfering RF signals is closer. For example, if the classifier unit has found that the source of interfering RF signals is a mobile phone, the system may determine to which of the two ears of the user the mobile phone is closer, whereupon the audio signals captured by that hearing instrument to which the interfering source is closer are transmitted via a wireless link to the other hearing instrument for being presented also to the other ear of the user by the other hearing instrument, i.e. the audio signals captured from the speaker of the mobile phone then are audible at both ears.

It is a further object of the invention to provide for a particularly simple remote control for a hearing assistance system.

According to the invention this object is achieved by a system and a method utilizing a standard communication or data processing device, such as a mobile phone or a Personal Digital Assistant, comprising an RF interface already for another purpose in a remote control mode in which it is operated by a control software which modulates the power of the RF interface of the device so that the need for a dedicated hardware remote control device is eliminated, since only a dedicated software is necessary to provided for the remote control function.

For example, the Bluetooth inquiry scan channel of a Bluetooth interface may be used for such RF power modulation.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
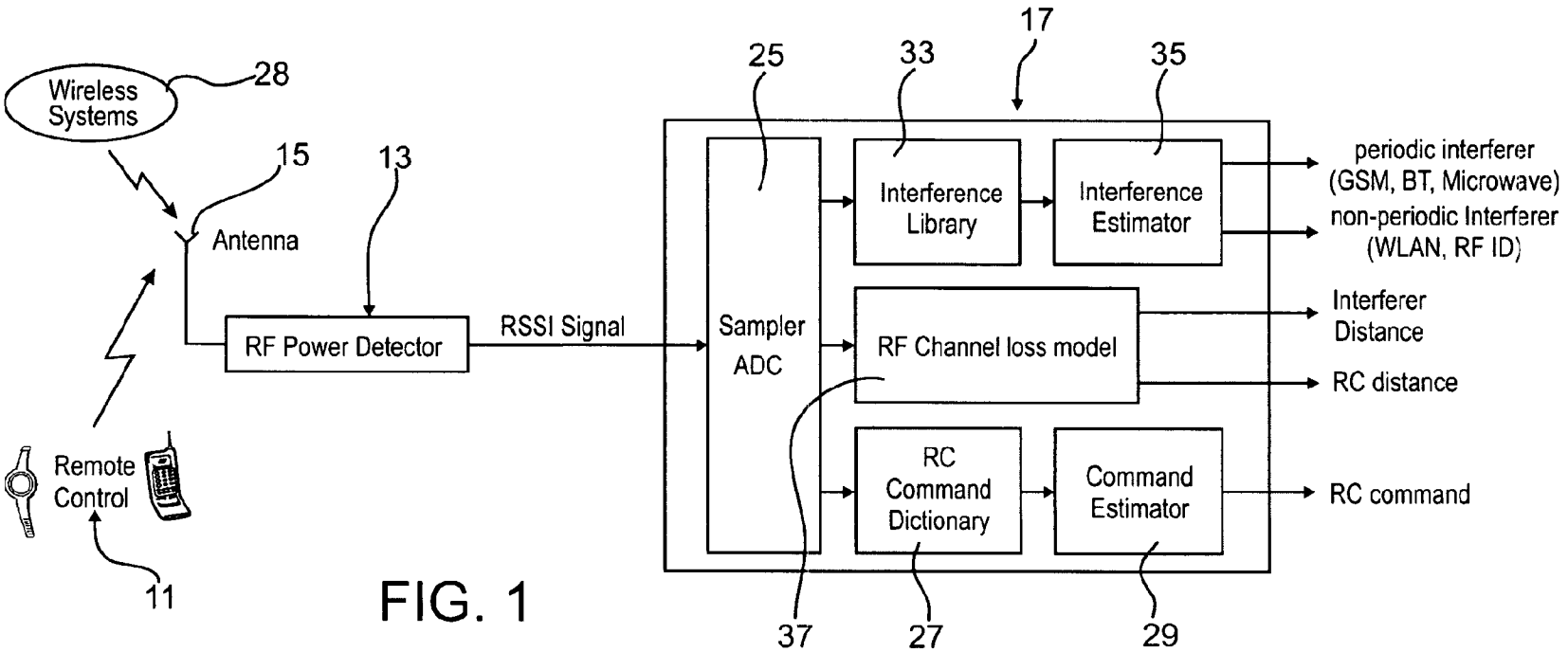
FIG. 1 is a block diagram of an example of an RF power detector and a classifier unit of a hearing assistance system according to the invention.

FIG. 1 is a block diagram of a portion of a system for providing hearing assistance to a user, which portion comprises a wireless remote control 11, an RF power detector 13 comprising a RF antenna 15, and a classifier unit 17.

According to one embodiment, the remote control 11 may be realized as a small battery powered watch attachment with a transmitter using producing an amplitude modulated (AM) RF signal, for example, 100% ASK (Amplitude Shift Keying) modulation. In this respect, a number of unlicensed bands is available, for example, at 433 MHz, 868 MHz and 2.4 GHz. According to another embodiment the remote control 11 could be realized as a common mobile phone or PDA having standard hardware which is operated by a specific control software which modulates the power of an RF transmitter of the mobile phone or PDA, such as a built-in GSM transmitter or a built-in Bluetooth transmitter.

The antenna 15 of the RF power detector 13 may be a dedicated structure, like a printed PCB (Printed Circuit Board) antenna, or a conductive element already used in the system for other purposes, like a microphone wire or a battery of a hearing instrument.

The RF power detector 13 is designed for outputting a signal representative of the power envelope of the RF signal received by the antenna 15, for example, as an RSSI (Received Signal Strength Indication) signal.

Figure 2:
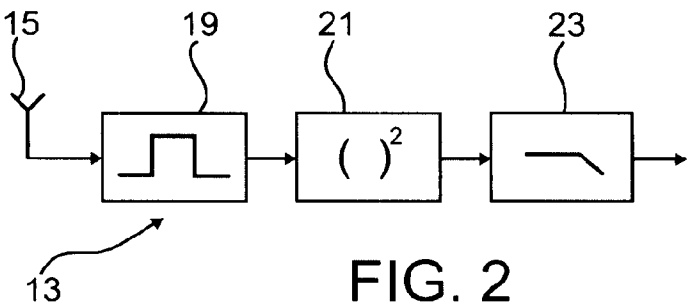
FIG. 2 is a block diagram of the RF power detector of the FIG. 1.

An example of a simple design of such RF power detector 13 is shown in FIG. 2, according to which the antenna signal is passed through a band pass filter 19 to a detector 21 which outputs the square of the input signal to a low pass 23. The analogue output signal of the low pass 23, which is representative of the power envelope of the received RF signal, is supplied to a sampling block 25, which may be part of the RF power detector 13 or part of the classifier unit 17 and which serves to digitize the power envelope signal provided by the RF power detector 13. The sampling band width needs to be in the range of the expected RF interferer burst repetition rate, for example of a few kHz. In its simplest version, the sampling block 25 is a one bit comparator. The RF power detector 13 is able to measure the RF power envelope within a certain bandwidth, for example from 0.5 to 2.8 GHz.

The classifier unit 17 serves several purposes.

First, it serves to detect control commands from the remote control 11 by analyzing the digitized power envelope detected by the RF power detector 13. To this end, the classifier unit 17 comprises a remote control command dictionary 27 to which the digitized RF power envelope signal of the sampling block 25 is provided in order to provide for an input to a command estimator 29, which outputs the corresponding remote control command as detected.

Second, the power envelope signal of the sampling block 25 is used for detecting the presence of a source 28 of interfering RF signals (i.e. an "interferer") in the vicinity of the RF power detector 13 by supplying the power envelope signal to an interference library 33 containing time-domain RF power schemes of different types of sources 28 of interfering RF signals. The signal provided by the interference library 33 is supplied to an interference estimator 35. Thus, in addition to detecting the mere presence of an interferer 28, also the type of interferer 28 can be determined, and a corresponding signal is provided by the interference estimator 35. Generally, the interferer 28 could be periodic, i.e. predictable, such as a TDMA (Time Division Multiplex Access) mobile phone such as a GSM mobile phone, a Bluetooth device or a microwave oven, or it could be a non-periodic interferer, such as a WLAN (Wireless Local Area Network) or a RFID (Radio Frequency Identification Device). The interferer 28 could be an "intentional" radiator, such as a mobile phone or a broadcast system, or it could be a "non-intentional" radiator, such as a laptop computer, a power supply or a fluorescence light. The interferer 28 may be considered as disturbing to the hearing assistance system, in which case countermeasures, e.g. for protecting a wireless link, may be taken, as it will be described hereinafter, or it may be considered as non-disturbing to the hearing assistance system. However, also in the latter case it may be interesting to measure the RF power, for example for providing for RF dosimeter functionality by integrating the measured RF power over time in order to determine the overall RF power accumulated during a certain time period to which the user's body, in particular the user's head, has been exposed. Such dosimeter functionality may include the generation of alarm signals to the user when a certain predefined RF power dose is reached, etc.

Third, the RF power envelope signal provided by the sampling unit 25 is supplied to an RF channel loss model 37 in order to determine the distance of the remote control 11 from the RF power detector 13 and the distance of the interferer 28 from the RF power detector 13, with the RF channel loss model 37 outputting a signal representative of the interferer distance and a signal representative of the remote control distance. To this end, the channel loss model 37 includes a transmission power library regarding the maximum transmission power of the remote control and regarding the standards of the maximum transmission power of the expected types of interferer 28, with the distance being determined by comparing the present transmission power determined by the RF power detector 13 and the respective value in the transmission power library. For example, for a given type of remote control 11 the transmission power in a distance of 1 m is exactly known. If, for example, the distance doubles, then the power reduces to one fourth so that for a distance of 2 m the transmission power falls to 25% (−6 dB). Thus, by measuring the received transmission power the distance can be estimated. The interferer 28 usually will transmit according to a standard protocol (such as DECT, GSM, WLAN, Bluetooth, etc.) which has a well-defined maximum transmission power. Thus, once the type of interferer 28 has been recognized by the interference estimator 35 with the help of the interference library 33, the distance of the interferer 28 can be estimated by the channel loss model 37 from the present transmission power measured by the RF power detector 13.

Figure 3:
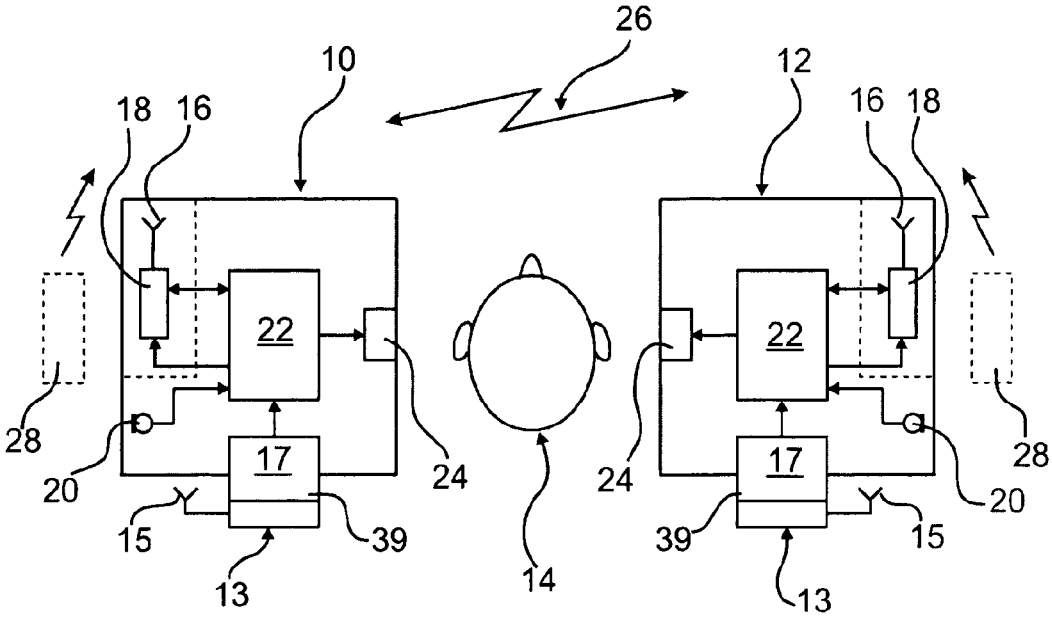
FIG. 3 is a block diagram of an example of a binaural hearing aid system according to the invention.

FIG. 3 shows an example of how the RF power detector 13 and the classifier unit 17 of FIG. 1 can be used in a hearing assistance system, such as a binaural hearing aid system. FIG. 3 is a block diagram of a binaural hearing aid system comprising a left-ear hearing aid 10 and a right-ear hearing aid 12 worn at the right and left ear of a user 14, respectively. Each hearing aid 10, 12 comprises an antenna 16, a receiver/transmitter unit 18, a microphone 20, a central processing unit 22 and an output transducer 24. The antenna 16 and the receiver/transmitter unit 18 enable communication between the hearing aids 10 and 12 via a wireless link 26 which may be an inductive link (utilization of the near field) or a radio frequency (RF) link (utilization of the far field), such as a frequency modulated (FM) link, for example a frequency shift keying (FSK) link, or an ultra-wide-band link. The link 26 is bi-directional and may serve to exchange audio signals and/or control data and commands between the hearing aids 10, 12. As will be explained subsequently, the audio signals are captured by the respective microphone 20, and the control data/commands may relate to the present setting of the respective hearing aid 10, 12 according to the present auditory scene determined by auditory scene analysis performed by the central processing unit 22. The link 26 may be a time division multiplex link or it may be a frequency division multiplex link.

The microphone 20 captures audio signals which are supplied to the central processing unit 22 in order to generate an input audio signal for the output transducer 24. Usually processing of the audio signals provided by the microphone 20 occurs depending on the auditory scene as analyzed by the central processing unit 22 in order to optimize perception of sound by the user 14. In a binaural system the central processing unit 22 exchanges audio signals and control data with the receiver transmitter unit 18 which has been received by the antenna 16 from the other hearing aid via the link 26 or which are to be transmitted to the other hearing aid via the link 26. The receiver/transmitter unit 18 is controlled by the central processing unit 22. In the central processing unit 22 audio signals received from the other hearing aid, i.e. from the other ear, may be added to the audio signals from the microphone 20, and also processing of the audio signals from the microphone 20 may be performed by taking into account information provided from the other hearing aid, whereby the perception of sound by the user 14 can be significantly improved.

The output transducer 24 serves to simulate the user's hearing and may be an electro-acoustic transducer (i.e. a loudspeaker), an electro-mechanical output transducer mechanically coupled to the ear, or a cochlea implant.

Examples of binaural hearing aid systems comprising a wireless link between the hearing aids are given in U.S. Pat. No. 6,549,633 B1, US 2004/0037442 A1 and US 2006/0018496 A1.

Each of the hearing aids 10, 12 is provided with or connected to a RF power detector 13 and a classifier unit 17. In the example shown in FIG. 3 the RF power detector 13 is external to the hearing aids 10, 12, whereas the classifier unit 17 is integrated into the hearing aids 10, 12. The antenna used by the RF power detector 13 may be a dedicated antenna 15, or, in particular if the RF power detector 13 is integrated in the hearing aid 10, 12, it also could be the RF antenna 16 of the hearing aid 10, 12 or any other appropriate conductive structure of the hearing aid 10, 12, such as microphone wire or a battery of the hearing aid 10, 12.

In the example shown in FIG. 3 the RF power detector 13 is connected to the classifier unit 17 of the hearing aids 10, 12 via an interface 39 which, according to one embodiment, could be a standardized EURO audio connector, or, according to another embodiment, a standardized I2C connector which is normally used just for fitting. In both cases such interface 39 would allow to DC-power the RF power detector 13.

If the interface 39 is an audio connector, the signal provided by the RF power detector 13, typically a logarithmic RSSI signal, could be converted by a voltage-controlled oscillator (not shown) to an audio frequency (for example from 300 Hz to 5 kHz), which could be easily measured within the hearing aids 10, 12 and which has a direct relationship to the RF power detected by the RF power detector 13.

The classifier unit 17 is connected to the central processing unit 22 in order to supply the various output signals shown in FIG. 1 to the core of the hearing aid 10, 12. The information provided by the classifier unit 17 thus can be utilized by the central processing unit 22 in order to control operation of the hearing aid 10, 12 accordingly. For example, the audio signal processing performed in the central processing unit 22 may be controlled according to the interference signal provided by the interference estimator 35 in order to suppress noise in the audio signal path caused by the presence of an interferer 28. To this end, the filter and the gain applied by the central processing unit 22 to the audio signals being processed may be adapted to the type of interferer 28. For example, if the detected interferer 28 is a periodic interferer, i.e. having a predictable time windows for the occurrence of bursts, the gain may be reduced during times when the occurrence of a burst is expected. This feature can be used also for "standalone" hearing instruments which do not have a wireless connection to a remote device other than the remote control 11.

However, if there is such wireless connection to a remote device, which in the embodiment shown in FIG. 3 is the respective other one of the hearing aids 10, 12, the information provided by the classifier unit 17 alternatively or in addition may be used to optimize operation of the wireless link, as it will be explained in the following.

During practical use of the hearing aids 10, 12 the link 26 may be disturbed by the presence of a source 28 of radio frequency signals interfering with the link 26 and having an amplitude changing periodically between a low amplitude regime ("idle time") and a high amplitude regime ("burst"), i.e. the energy of the interfering RF signals changes periodically. An example of such interfering RF signal source 28 is a mobile phone which is used at one of the ears of the user 14 and hence in close proximity to one of the hearing aids 10, 12. Mobile phones usually emit time-division-multiple-access (TDMA) signals, which often obey the GSM standard.

Figure 4:
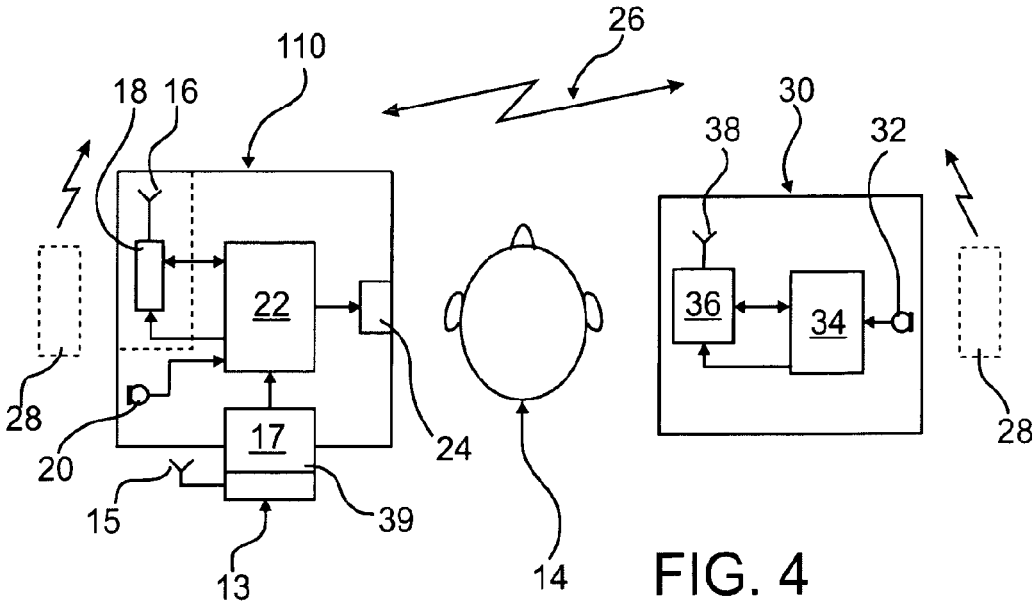
FIG. 4 is a block diagram of an example of a CROS/BiCROS system according to the invention.

An example of a GSM signal is shown in FIG. 4. GSM signals use frequency bands at 900 MHz and 1800 MHz with a maximum transmission power of 2 W and 1 W, respectively. A GSM signal is divided into frames, each having a length of 4.62 msec. Each frame is divided into 8 time slots, each having a length of 0.58 msec. One of these 8 time slots is dedicated to the respective GSM device, so that each GSM device transmits only during ⅛ of each frame, i.e. the GSM device periodically transmits bursts having a length of 0.58 msec with a repetition period of 4.62 msec. Thus a GSM signal can be considered as a signal having an amplitude changing periodically between a low amplitude regime during which the amplitude is essentially zero and which has a duration of about 4.04 msec. and a high amplitude regime during which the amplitude is essentially constant and which has a duration of about 0.58 msec. In the following, the high amplitude regime also will be labeled as "bursts", while the low amplitude regime also will be labeled "idle time".

Signals of similar structure and at similar frequency bands are also emitted by devices using the DECT standard, which is commonly used for cordless phones and which is divided into time frames of a length of 10 msec. which are divided into time slots having a duration of about 0.42 msec., or by devices using the Bluetooth standard, which has a burst repetition period of 1.25 msec., with each burst lasting for 0.37 msec.

Without counter-measures, the link 26 between the hearing aids 10 and 12 would be heavily disturbed and usually would break down during transmission of the bursts of an RF interfering device 28 if such device 28 was used at one of the ears of the user 14. In this respect it has to be noted that the bursts primarily would disturb reception of the signals transmitted via the link 26, while transmission of the signals essentially would not be affected. Due to the relatively small distance between the ears in most cases reception of the signals transmitted via the link 26 would be heavily disturbed by the RF interfering device 28 both in the case which the device 28 is used at that hearing aid which is presently receiving and in the case in which the device 28 is used at that hearing aid which is presently transmitting. However, there may be cases in which heavy disturbance of the reception occurs only if the interfering device 28 is used at that hearing aid which is presently receiving.

In order to avoid disturbance of the link 26—and in particular to avoid loss of data—during the presence of a RF interfering device 28 the binaural system, by providing the RF power detector 13 and the classifier unit 17, is designed such that it is permanently detected whether a source 28 of RF signals interfering with the link 26 and having an amplitude changing periodically between a low amplitude regime and a high amplitude regime is present in the vicinity of one of the hearing aids 10, 12 (as already mentioned above, in some cases it may be sufficient to detect only whether such source 28 is present in the vicinity of that hearing aid which is presently receiving). During times in which no presence of an interfering RF source is detected, the binaural system is operated in a base mode, i.e. a conventional wireless data/audio signal exchange mode. As long as the presence of a source of interfering RF signals is detected, the system switches into an interference mode in which the transmission of signals via the link 26 is synchronized to the periodicity of the amplitude of the interfering RF signals in such a manner that the signals are transmitted via the link 26 only during the low amplitude regime, i.e. the idle times of the interfering RF signals.

In most cases it will be necessary that transmission from any of the two hearing aids 10, 12 occurs in the interference mode irrespective of the question at which of the two hearing aids 10, 12 the interfering device 28 is used. As already mentioned above, in some cases it may be sufficient that only transmission from that hearing aid at which the interfering device 28 is not used occurs in the interference mode while transmission from that hearing aid at which the interfering device 28 is used may occur in the base mode.

Further, in view of the fact that the interfering device 28 usually will be a phone, in the interference mode preferably audio signals captured by that hearing aid to which the interfering device 28 is closer are not only presented to the respective ear via the output transducer 24 of that hearing aid, but are also transmitted via the link 26 to the other hearing aid for being presented also to the other ear of the user. By comparing the interferer distance signals provided by the RF channel loss model 37 of the classifier unit 17 of each hearing aid 10, 12 it can be determined to which of the hearing aids 10, 12 the interferer 28 is closer.

Synchronization of the transmission of the signals via the link 26 in the interference mode may be achieved by measuring the amplitude of the interfering radio frequency signals in time domain by the RF power detector 13 and predicting the idle time periods, i.e. the periods of time during which the low amplitude regime will prevail, by the classifier unit 17.

The control of the two hearing aids 10, 12 regarding the interference mode may be realized by a symmetric architecture or by a master/slave architecture; in the latter case one of the hearing aids 10, 12 would be the master while the other one would be the slave.

Figure 6:
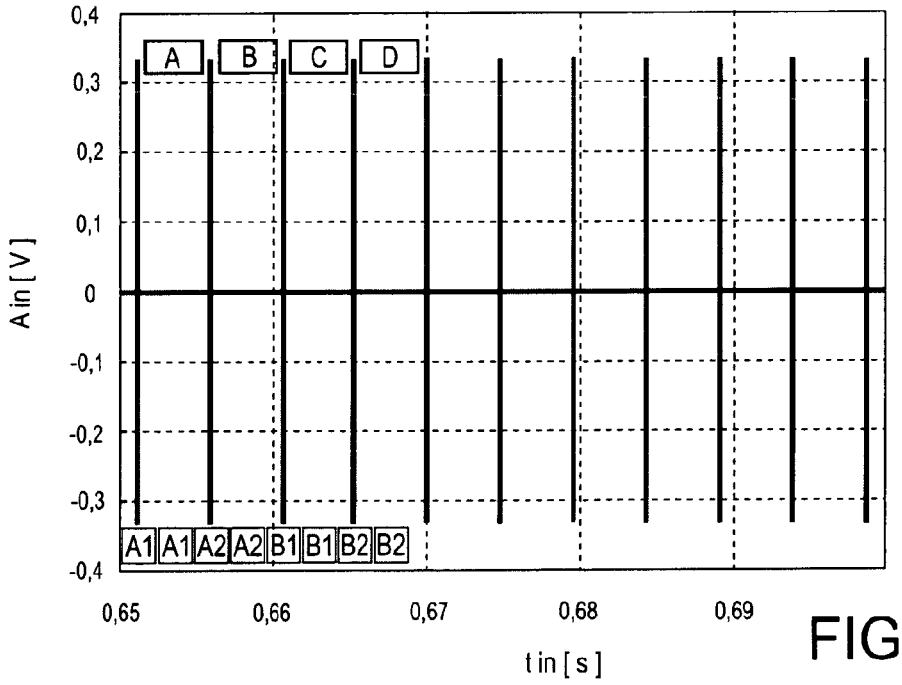
FIG. 6 is a diagram of an example of the amplitude of a GSM signal versus time, shown together with two examples of the data packets transmitted by a hearing assistance system according to the invention in the interference mode.

An example of the data/audio signal transmission in the interference mode is shown in the upper part of FIG. 6, according to which the data to be transmitted is divided into packets A, B, C, D, etc. of equal length which is slightly less than the duration of the idle time period between two adjacent bursts of the GSM interfering signal. The data packets A, B, . . . are transmitted only during the idle time periods so that there is no overlap with the bursts.

According to an alternative embodiment, transmission of the signals in the interference mode may be controlled such that the signal is transmitted in packets A1, A2, B1, B2, etc. having a length of not more than half of the idle time period, i.e. the period length of the low amplitude regime, with each packet subsequently being transmitted twice. In this case no synchronization of the transmission with the idle time periods is necessary, since by reducing the packet length to half of the idle time period length and by transmitting each packet twice it is ensured that each packet is transmitted once completely within an idle time period without overlap with the bursts. This is also apparent from the lower part of FIG. 6. In this example, the packet A of the upper part of FIG. 4 has been divided into two portions A1 and A2, and the packet B has been divided into two packets B1, B2, etc. It is apparent that this simpler solution, which does not require synchronization to the phase of the interfering signal, the data transmission rate is roughly reduced by a factor of 2 due to the need to transmit each packet twice so that the bandwidth is reduced accordingly in the interference mode. By contrast, according to the solution in which transmission occurs only during the idle time periods the bandwidth is reduced only slightly with respect to the base mode (i.e. only by about ⅛).

This concept is applicable not only to binaural hearing aid systems; rather, it is generally applicable to any hearing assistance system comprising a hearing instrument which is connected to a remote device, i.e. a device spaced apart from the hearing instrument, via a wireless link for receiving data/audio signals from that remote device. Consequently, the embodiment of FIG. 3 may be considered as a specific case of this more general concept, wherein the remote device is the second hearing aid.

Figure 5:
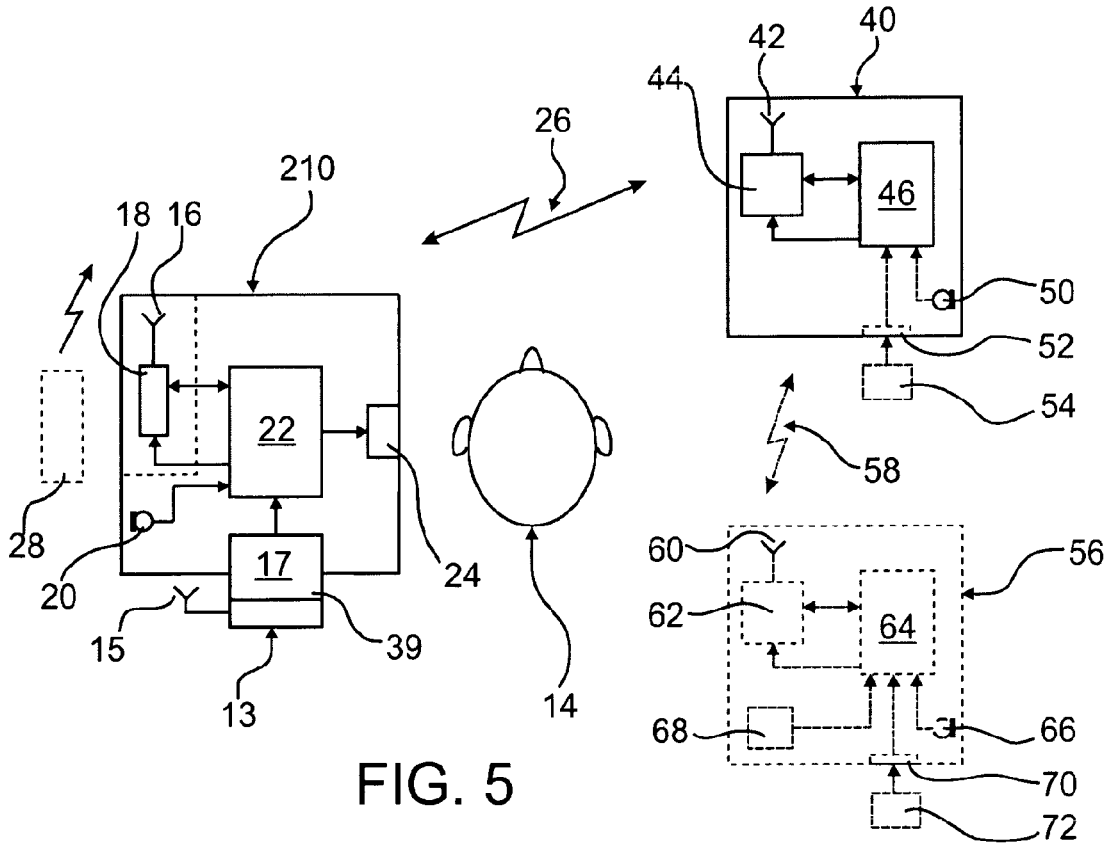
FIG. 5 is a block diagram of an example of a hearing assistance system according to the invention comprising a hearing aid and an accessory device connected via a wireless link to the hearing aid.

FIGS. 4 and 5 show other examples of the application of a RF power detector 13 and a classifier unit 17 for hearing assistance systems comprising a wireless link to a remote device in addition to the wireless link to the remote control 11. According to FIG. 4 the remote device is a wireless microphone unit 30 of a CROS or BiCROS system, whereas in the example of FIG. 5 the remote device is an accessory device 40 which is connected to a hearing instrument 210 worn at one of the user's ears via a wireless link 26 (usually the system will comprise a second hearing instrument (not shown in FIG. 5) worn at the other one of the user's ears).

According to FIG. 4 the microphone unit 30 is connected via a wireless link 26 with a hearing instrument 110 which is generally similar to the hearing aid 10 of FIG. 3. In the case of a CROS system, the hearing instrument 110 would not include the microphone 20.

The hearing instrument 110 is worn at the better ear of the user 14, while the microphone unit 30 is worn at the worse ear. The microphone unit 30 comprises a microphone 32, a central processing unit 34, a receiver transmitter unit 36 and an antenna 38. The audio signals generated by the microphone 32 are processed in the central unit 34 and then are supplied to the receiver/transmitter unit 36 for being transmitted via the antenna 38 over the link 26 to the hearing instrument 110 in order to be presented via the output transducer 26 to the better ear of the user 14. In a BiCROS system these audio signals will be combined in the central processing unit 22 of the hearing instrument 110 with audio signals captured by the microphone 20 of the hearing instrument 110.

If the presence of an interfering device 28 at the hearing instrument 110 is detected, transmission of the audio signals from the microphone unit 30 will occur in the interference mode. In most cases this will also apply if an interfering device 28 is detected at the microphone unit 30. Detection of the presence of an interfering device 28 at the hearing instrument 110 or at the microphone unit 30 will be performed by the RF power detector 13 and the classifier unit 17. If the interfering device 28 is detected at the microphone unit 30, corresponding information has to be transmitted to the microphone unit 30 from the hearing instrument 110; such information may include the confirmation that transmission has to occur in the interference mode, information regarding where the interfering device 28 is located (i.e. at the hearing instrument 110 or the microphone unit 30), information regarding the burst length and the idle time length, and information regarding the phase of the interfering signal (this is necessary only if in the interference mode the transmission has to be synchronized to the phase of the idle times).

In FIG. 5 an embodiment is shown wherein the remote device is an accessory device 40 which is connected to a hearing instrument 210 worn at one of the user's ears via a wireless link 26. The accessory device 40 may be designed for use by another person, such as a teacher teaching hearingimpaired pupils in a classroom, or it may be designed for being worn or used by the person 14 using the hearing instrument 210. In the latter case, the accessory device 40 may be worn somewhere at the user's body, except for the head. Further, the accessory device 40 could designed for stationary use somewhere in the room where the user 14 of the hearing instrument 210 stays.

Usually the accessory device 40 will comprise at least an antenna 42, a receiver/transmitter unit 44 and a central processing unit 46. The central processing unit 46 controls the receiver/transmitter unit 44 and provides the data to be transmitted via the antenna 42 over the link 26 to the hearing instrument 210.

The accessory device 40 may serve as an audio signal source for the hearing instrument 210. To this end, it may be provided with a microphone 50 and/or an input 52 for an external audio source 54, such as a phone, a television device, a hi-fi-system, etc.

Rather then being directly connected to the accessory device 40 via the input 52, such external audio source also could be represented by a device 56 which is connected to the accessory device 40 via a wireless link 58. Such external device 56 may include an antenna 60, a transmitter 62, a central unit 64, a microphone 66, an audio signal source 68 and/or an input 70 for an audio source 72.

In the embodiment of FIG. 5 it is sufficient to detect whether an interfering device 28 is close to the hearing instrument 210. Such detection will be performed by the RF power detector 13 and the classifier unit 17. As soon as the presence of an interfering device 28 is detected, transmission of the signals from the accessory device 40 will occur in the interference mode. In case that the presence of an interfering device 28 is detected, corresponding information will have to be transmitted from the hearing instrument 210 to the accessory device 40.

In the above embodiments the antenna 16 and receiver/transmitter unit 18 have been shown as a part of the hearing instrument 10, 110, 210. However, according to an alternative embodiment, all elements necessary for the link 26 could be part of a separate receiver/transmitter unit which is mechanically and electrically connected to the hearing instrument 10, 110, 210, e.g. via an audio shoe (this is indicated by a dashed line around 16, 18 in FIGS. 3 to 5).

Moreover, in the above embodiments only periodic interfering FM signals have been discussed in which idle times and bursts are repeated subsequently. However, the present invention is generally applicable to any interfering FM signals which have a transmission power changing according to a predictable scheme between low power regimes and high power regimes. In that case, transmission of the signals from the remote device to the hearing device are synchronized to the detected power scheme of the interfering signals in such a manner that the signals are transmitted only during the low power regimes. To this end, the hearing device will identify the detected power scheme in order to predict the times of the low power regimes, e.g. with the help of a library of known transmission power schemes. According to an alternative embodiment, the transmission of the signals from the remote device to the hearing device is controlled such that the signals are transmitted in packets each having a length of not more than half the length of the shortest one of the low power regimes of the detected power scheme, with each packet subsequently being transmitted twice.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A system for providing hearing assistance to a user, comprising:

a wireless remote control for transmitting control commands as an amplitude modulated radio frequency signal, a radio frequency power detector for outputting a signal representative of the power envelope of the radio frequency signal received by an antenna of the radio frequency power detector, a classifier unit for analyzing the output signal of the radio frequency power detector in order to detect control commands of the remote control and to detect the presence of a source of interfering radio frequency signals, an audio signal processing unit, and means worn to be worn at or at least in part in the user's ear for stimulating the user's hearing according to audio signals processed in the audio signal processing unit, wherein the classifier unit is for providing a control signal representative of the detected remote control commands and an interference signal representative of the presence of a source of interfering radio frequency signals, and wherein operation of the audio signal processing unit is controlled by said control signal.

2. The system of claim 1, wherein operation of the audio signal processing unit is controlled according to the interference signal in order to suppress noise caused by the presence of a source of interfering radio frequency signals.

3. The system of claim 1, wherein the classifier unit is capable of detecting a type of the source of interfering radio frequency signals, with the interference signal provided by the classifier unit comprising information regarding the type of the source of interfering radio frequency signals.

4. The system of claim 3, wherein the classifier unit comprises an interference library for detecting the type of the source of interfering radio frequency signals, said interference library containing time-domain radio frequency power schemes of different types of sources of interfering radio frequency signals.

5. The system of claim 3, wherein the classifier unit is capable of detecting whether the transmission power of the source of interfering radio frequency signals changes according to a predictable scheme between low power regimes and high power regimes in order to predict the times when the low power regimes and the high power regimes are to be expected.

6. The system of claim 5, wherein the audio processing unit is controlled according to the predictions of the classifier unit regarding the scheme of the interfering radio frequency signals.

7. The system of claim 1, wherein the classifier unit is capable of determining the distance of the source of interfering radio frequency signals from the radio frequency power detector in order to output an interference source distance signal.

8. The system of claim 1, wherein the classifier unit is capable of determining the distance of the remote control from the radio frequency power detector in order to output a remote control distance signal.

9. The system of claim 7, wherein the classifier unit includes a channel loss model in order to generate at least one of the interference source distance signal and the remote control distance signal, which channel loss model includes a transmission power library of the maximum transmission power of the remote control and of the standards of maximum transmission power of the expected types of sources of interfering radio frequency signals, wherein the distance is determined by comparing the present transmission power determined by the radio frequency power detector and the respective value in the transmission power library.

10. The system of claim 1, wherein the audio signal processing unit and the stimulating means are part of a hearing instrument to be worn at or at least in part in the user's ear.

11. The system of claim 1, wherein the classifier unit is part of the hearing instrument.

12. The system of claim 1, wherein the output signal of the radio frequency power detector has a frequency representative of the detected radio frequency power, with the frequency being measured by classifier unit.

13. The system of claim 12, wherein the output signal of the radio frequency power detector is generated by a voltage-controlled oscillator to which a RSSI signal representative of the envelope of the radio frequency power received by the antenna of the radio frequency power detector is supplied.

14. The system of claim 10, wherein the radio frequency power detector is connected to the hearing instrument via a standard audio connector.

15. The system of claim 10, wherein the power detector is connected to the hearing instrument via an standard I2C connector.

16. The system of claim 10, wherein the radio frequency power detector is part of the hearing instrument.

17. The system of claim 10, wherein the system comprises a remote device spaced apart from the hearing instrument for establishing a wireless link between the remote device and the hearing instrument for transmitting audio signals from the remote device to the hearing instrument.

18. The system of claim 17, wherein means are provided for operating the system in an interference mode as long as the presence of a source of signals interfering with the wireless link is detected, in which interference mode the transmission of the signals from the remote device to the hearing instrument is synchronized to the detected power scheme of the interfering signals in such a manner that the signals are transmitted only during the low power regimes.

19. The system of claim 17, wherein the remote device is selected from the group consisting of a microphone unit which is worn at the other one of the user's ears; a remote device comprising an external microphone and to be worn by another person or is worn by the user; and a device for wireless transmission of audio signals from an audio signal source to the hearing instrument.

20. The system of claim 17, wherein the remote device is a hearing instrument which comprises means for stimulating the user's hearing and which is worn at the other one of the user's ears.

21. The system of claim 20, wherein both hearing instruments comprise at least one microphone, and wherein the wireless link is a bi-directional audio signal link for exchanging the audio signals captured by each of the microphones between the hearing instruments.

22. The system of claim 20, wherein the wireless link serves as a bi-directional data link for exchanging at least one of control data and commands between the hearing instruments.

23. The system of claim 20, wherein the hearing instrument forming the remote device comprises or is connected to a radio frequency power detector for outputting a signal representative of the power envelope of the radio frequency signal received by an antenna of the radio frequency power detector and a classifier unit for analyzing the output signal of the radio frequency power detector in order to detect control commands of the remote control and to detect the presence of a source of interfering radio frequency signals, wherein the classifier unit is for providing a control signal representative of the detected remote control commands and an interference signal representative of the presence of a source of interfering radio frequency signals, wherein the classifier unit is capable of determining the distance of the source of interfering radio frequency signals from the radio frequency power detector in order to output an interference source distance signal, and wherein the system is capable of determining the location of the source of interfering radio frequency signals by comparing the interference source distance signals provided by the classifier units of the two hearing instruments.

24. The system of claim 23, wherein the system is capable of determining to which of the hearing instruments the source of interfering radio frequency signals is closer by comparing the interference source distance signals provided by the classifier units of the two hearing instruments it is.

25. The system of claim 24, wherein the system is designed such that if the presence of a source of interfering radio frequency signals has been detected, audio signals captured by that hearing instrument to which the source of interfering radio frequency signals is closer are presented to the respective ear of the user by that hearing instrument and also are transmitted to the other hearing instrument for being presented to the other ear of the user by the other hearing instrument.

26. The system of claim 1, wherein the remote control is a communication device or a data processing device comprising a remote control mode in which it is operated by a control software which modulates the transmission power of an radio frequency interface of the device.

27. The system of claim 1, wherein the classifier unit comprises a remote control command dictionary for detecting the control commands.

28. The system of claim 1, wherein the amplitude modulated radio frequency signal is an ASK signal.

29. The system of claim 1, wherein the classifier unit or the radio frequency power detector comprises a sampling block for digitizing the output signal of the radio frequency power detector.

30. The system of claim 29, wherein the sampling rate of the sampling block is at least twice the shortest expected burst repetition rate of the interfering radio frequency signals.

31. The system of one of claims 29, wherein the sampling block comprises a one-bit comparator.

32. A system for providing hearing assistance to a user, comprising:

a wireless remote control for transmitting control commands as an amplitude modulated radio frequency signal, a radio frequency power detector for outputting a signal representative of the power envelope of the radio frequency signal received by an antenna of the radio frequency power detector, a classifier unit for analyzing the output signal of the radio frequency power detector in order to detect control commands of the remote control, an audio signal processing unit, and means worn to be worn at or at least in part in the user's ear for stimulating the user's hearing according to audio signals processed in the audio signal processing unit, wherein the classifier unit is for providing a control signal representative of the detected remote control commands, wherein operation of the audio signal processing unit is controlled by said control signal, and wherein the remote control is a communication device or a data processing device comprising a remote control mode in which it is operated by a control software which modulates the transmission power of an radio frequency interface of the device.

33. The system of claim 32, wherein the device is a mobile phone or a Personal Digital Assistant.

34. The system of 32, wherein the device comprises a Bluetooth interface.

35. A method of operating a hearing assistance system comprising a remote control, an radio frequency power detector, a classifier unit, an audio signal processing unit, and means worn at or at least in part in the user's ear for stimulating the user's hearing according to audio signals processed in the audio signal processing unit, the method comprising:

transmitting, from the remote control, control commands as an amplitude modulated radio frequency signal;

outputting, from the radio frequency power detector, a signal representative of the power envelope of the radio frequency signal received by an antenna of the radio frequency power detector;

analyzing, by the classifier unit, the output signal of the radio frequency power detector in order to detect control commands of the remote control and to detect the presence of a source of interfering radio frequency signals;

providing, by the classifier unit, a control signal representative of the detected remote control commands and an interference signal representative of the presence of a source of interfering radio frequency signals; and controlling operation of the audio signal processing unit by said control signal.

36. The method of claim 35, wherein the radio frequency power detected by the radio frequency power detector is integrated over time in order to provide for an radio frequency power dosimeter functionality.

37. A method of operating a hearing assistance system comprising a remote control, an radio frequency power detector, a classifier unit, an audio signal processing unit, and means worn at or at least in part in the user's ear for stimulating the user's hearing according to audio signals processed in the audio signal processing unit, the method comprising:

transmitting, from the remote control, control commands as an amplitude modulated radio frequency signal;

outputting, from the radio frequency power detector, a signal representative of the power envelope of the radio frequency signal received by an antenna of the radio frequency power detector;

analyzing, by the classifier unit, the output signal of the radio frequency power detector in order to detect control commands of the remote control;

providing, by the classifier unit, a control signal representative of the detected remote control commands; and controlling operation of the audio signal processing unit by said control signal;

wherein the remote control is a communication device or a data processing device comprising a remote control mode in which it is operated by a control software which modulates the transmission power of an radio frequency interface of the device.

* * * * *